US007775384B2

(12) United States Patent
Zaguroli, Jr.

(10) Patent No.: US 7,775,384 B2
(45) Date of Patent: Aug. 17, 2010

(54) ELECTRIC MOTOR DRIVEN TRAVERSING BALANCER HOIST

(76) Inventor: James Zaguroli, Jr., 3030 Loon Lake Shores, Drayton Plains, MI (US) 48020

( * ) Notice: Subject to any disclaimer, the term of this patent is extended or adjusted under 35 U.S.C. 154(b) by 0 days.

(21) Appl. No.: 12/290,975

(22) Filed: Nov. 5, 2008

(65) Prior Publication Data

US 2009/0101877 A1 Apr. 23, 2009

Related U.S. Application Data

(62) Division of application No. 11/385,011, filed on Mar. 20, 2006, now Pat. No. 7,467,723.

(60) Provisional application No. 60/663,305, filed on Mar. 18, 2005.

(51) Int. Cl.
*B66C 19/00* (2006.01)

(52) U.S. Cl. ..... 212/331; 212/328

(58) Field of Classification Search ..... 212/328, 212/331

See application file for complete search history.

(56) References Cited

U.S. PATENT DOCUMENTS 3,313,014 A * 4/1967 Lemelson ..... 29/33 P
3,428,298 A 2/1969 Powell
3,921,959 A 11/1975 Ulbing
4,163,929 A 8/1979 Janu et al.
4,807,767 A 2/1989 Kornely
4,917,360 A 4/1990 Kojima
5,174,217 A * 12/1992 Wakabayashi ..... 105/29.1
5,350,075 A 9/1994 Kahlman
5,489,032 A 2/1996 Mayhall, Jr. et al.
5,593,138 A 1/1997 Zaguroli, Jr.
5,850,928 A 12/1998 Kahlman et al.
5,865,426 A 2/1999 Kazerooni
5,915,673 A 6/1999 Kazerooni
6,204,619 B1 3/2001 Gu et al.
6,204,620 B1 3/2001 McGee et al.
6,241,462 B1 6/2001 Wannasuphoprasit et al.
6,299,139 B1 10/2001 Kazerooni
6,313,595 B2 11/2001 Swanson et al.
6,386,513 B1 5/2002 Kazerooni
6,554,252 B2 4/2003 Kazerooni et al.
6,575,317 B2 6/2003 Taylor
6,595,493 B2 7/2003 Krebs et al.
6,612,449 B1 9/2003 Otani et al.
6,622,990 B2 9/2003 Kazerooni (Continued)

*Primary Examiner*—Thomas J. Brahan
(74) *Attorney, Agent, or Firm*—John R. Benefiel

(57) ABSTRACT

A balancer hoist has an electric servomotor driving irreversible gearing in turn driving a hoist chain drive. A float mode and a manual mode are provided using two independent load sensors for sensing the load weight and force applied to a control grip. A traversing control is produced by a tractor carriage rolling on an overhead rail connected to a trolley also traveling on the rail and supported on upper hoist assembly. A load sensor interconnects the tractor carriage and upon hoist assembly to sense forces created by an operator pulling on the chain, which are used to control an electric motor on the tractor carriage driving a pinion gear engaged with a gear rack on the overhead rail to positively drive the carriage, trolley and upper hoist assembly along the rail. A stationary dual hoist system is also described in which two hoist assemblies are interconnected by a chain and sprockets to provide synchronized operation.

6 Claims, 14 Drawing Sheets

U.S. PATENT DOCUMENTS

| | | | | |
|---|---|---|---|---|
| 6,668,668 | B1 | 12/2003 | Peshkin | |
| 6,681,638 | B2 | 1/2004 | Kazerooni et al. | |
| 6,738,691 | B1 | 5/2004 | Colgate et al. | |
| 6,796,447 | B2 | 9/2004 | Laundry et al. | |
| 6,813,542 | B2 | 11/2004 | Peshkin et al. | |
| 6,840,393 | B2 | 1/2005 | Tu | |
| 7,185,407 | B2 * | 3/2007 | Boyl-Davis et al. | 29/33 R |
| 2002/0111712 | A1 | 8/2002 | Peshkin et al. | |
| 2002/0112016 | A1 | 8/2002 | Peshkin et al. | |
| 2004/0026349 | A1 | 2/2004 | Colgate et al. | |
| 2004/0143364 | A1 | 7/2004 | Colgate et al. | |

* cited by examiner

ELECTRIC MOTOR DRIVEN TRAVERSING BALANCER HOIST

CROSS REFERENCE TO RELATED APPLICATION

This application claims the benefit of provisional patent application Ser. No. 60/663,305, filed on Mar. 18, 2005.

This application is a division of utility patent application Ser. No. 11/385,011 filed Mar. 20, 2006 now U.S. Pat. No. 7,467,723.

BACKGROUND OF THE INVENTION

Balancing hoists have long been known in which a drum has a length of cable wound and unwound thereon as the drum is rotated in either direction to position a load held by the cable. This arrangement has utilized pneumatically operated hoists which use regulated air pressure acting on a piston to cause cable wind up or pay out by rotation of the drum. See U.S. Pat. No. 3,428,298 for a detailed description of this type of hoist. The load can be raised or lowered by the operator by exerting a low level force on the suspended load which increases or decreases the air pressure acting on the piston slightly, which pressure change is made up by a regulator to lower or raise the load accordingly.

The limited stroke of the piston limits the cable travel that can be obtained, and thus electrical motor driven balancer hoist have been developed, as described in U.S. Pat. Nos. 3,921,959 and 4,807,767.

The servo motor typically drives a planetary reduction gear, the output of which drives the cable wind up drum.

Since the cable is elastically stretchable to a significant degree, it has considerable stored energy when heavily loaded.

If the cable breaks, a hazard can be created by whipping of the cable caused by release of the stored energy when the cable breaks or when there is some other failure. Emergency brakes have been employed to prevent rapid unwinding of the cable in this situation.

The mass of the planetary gearing also increases the momentum of the movable components when winding or unwinding is underway. The control of the servo motor is made more complicated by the cable stretch and the momentum of the rotating components, creating complex dynamics, particularly at the high speeds which the electric servo motor drive systems operate.

The cable must always be maintained in tension during raising and lowering operation of the hoist in order to avoid loose turns in the cable windings on the drum leading to tangling of the windings, interfering with later unwinding. Sensors and complicated software are required to insure that this does not occur.

Thus, the use of a chain in balancing hoists would be preferable to eliminate difficulties in winding of a cable and the hazards associated with cable stretching. The use of a chain in a balancer hoist is shown in U.S. Pat. No. 3,921,959. However, the mass of a chain wound on a drum is relatively great, and when combined with the mass of a planetary gear set, this affects the response of an electric motor driven balancer hoist.

In some electric motor driven balancer hoists, load sensors sense a change in the load on the cable or chain to cause the electric motor to drive a drum to raise or lower the cable or chain balance a load in "float" mode.

The weight of an operator's hand can upset the "float" balance, since the load sensor will react to removal of the operator's hand from the handle.

Alternatively, manipulation of a handle or grip connected to the cable causes the motor to selectively drive the motor so as to raise or lower the load at a rate proportional to an up or down force applied by the operator to the grip.

Automatic controls can also execute raising or lowering motions to programmed stops as when repetitive motion cycles occur.

Such self balancing hoists have been mounted on trolleys traversed along an overhead aluminum rail track system. In order to assist movement of the trolleys, pulling on the cable by the operator in a given direction is sensed by a power cable angle sensor and powered driving of the trolley in that direction is created in response to sensing such cable pull. The cable angle sensor would be problematic with a chain, and has other limitations.

Also, trolleys have in the past been driven by friction wheels engaging a smooth surface on the aluminum rail. However, friction wheel slippage can sometimes occur especially under heavy loads, which slippage upsets the accurate functioning of the control system, as a commanded movement of the trolley may not occur if such slippage is encountered. A hoist utilizing a chain wound up on a drum would be especially troublesome.

It may be desirable to alternatively allow a free wheeling manually induced movement of the trolley, which has not heretofore been provided in a powered 21 trolley system.

Another application of pneumatic balancing hoists is the combining of two such hoists to lift a common load by synchronizing the motion of the two cables as described in U.S. Pat. No. 5,593,138. Again, the problems of improper cable winding may encountered with a lift cable and lift travel is limited by the relative short piston strokes as a practical matter.

It is an object of the present invention to provide an electrically powered balancer hoist using a chain which has a minimum mass of the components rotated by the electrical motor to allow the use of a chain while still providing good performance.

It is a further object of the present invention to provide an electric motor drive chain hoist with an automatic float mode as well as manual mode using a handle grip in which the operator's hand on the handle does not affect the float mode.

It is another object of the present invention which incorporates powered, sensor controlled trolley movement which is accurate and more reliable, and selectively allows free wheeling of the trolley.

It is a further object to provide a double hoist system using a servo motor drive and hoist chain lift.

SUMMARY OF THE INVENTION

The present invention comprises improvement to a hoist which utilizes a chain to support the load, the chain positively driven by an electric servo motor through a low mass self locking worm gear drive which holds the supported load whenever the motor is denergized. The chain is not wound up onto a drum but driven linearly by a positive rotary drive hub, the chain optionally able to be routed into a collection receptacle. The use of a hoist chain eliminates the stored energy problem of cable hoists, as a chain does not stretch appreciably compared to a cable, and the low mass of a worm gear drive minimizes the momentum of the rotated components to provide high performance of the balancer function. This avoids the disadvantages of a cable hoist, such as the need for sophisticated control over winding and unwinding of a flexible cable on a drum, the hazards of stored energy in a stretched cable, and the other disadvantages described.

Two load sensors are used in the hoist up-down control, held in a control box supported on the lower end of the chain. The #1 load cell is connected between separate upper and lower load shafts passing through the control box, the lower load shaft connected to the load hook or eye to generate signals corresponding to the weight of the load signals these used to drive the load up or down when the operator directly pulls up or presses down on the load attached to the hook or eye.

The #2 load sensor is used when the hoist control system is switched to a manual control as by activation of a push button switch on the control box. A handle grip is mounted to be slidable on the lower load shaft and connected via the #2 load sensor to the upper load shaft. The #2 load sensor creates signals in response to up or down pressure exerted on the control grip by the user causing up or down hoist operation in correspondence to up or down force applied to the grip. Forces applied to the grip do not affect the #1 load sensor since the #1 load sensor is connected below the upper connection point of the #2 load sensor support, and since the handle is slidable on the lower load shaft so as to prevent any possible effects on the system if the grip is held or released when the hoist controls are set to the balance mode.

To improve performance of the trolley drive system, steel gear rack sections are clamped onto standard overhead rails and engaged with a pinion gear driven by electric motor powered tractor carriage connected to a hoist trolley. This creates a positive drive for powered positioning of the hoist trolley along an overhead rail;

The pinion gear reaction pushes an engaged gear rack more tightly against the rail surface to insure retention of the gear rack on the overhead rail.

The pinion gear is mounted on the tractor carriage which is connected to the hoist trolley which is supported on wheels on the rail for rolling movement along the rail. The hoist assembly is supported on the trolley so as to allow relative movement thereon. The hoist assembly is connected to the tractor carriage by a load sensor which senses the force developed when an operator pulls on the hoist chain to provide a control signal such that the hoist is automatically pulled horizontally in the direction desired by the operator by controlled activation of the drive motor. A two axis sensor allows movement in a second orthogonal direction.

In an alternate embodiment, the pinion can be declutched to allow free movement of the trolley, and an encoder is provided to keep track of the trolley movement during free movement thereof.

A tandem combination of two hoists is created by connecting two chain sprockets to the worm wheel of each drive to insure synchronized rotation of both chain drive motors.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
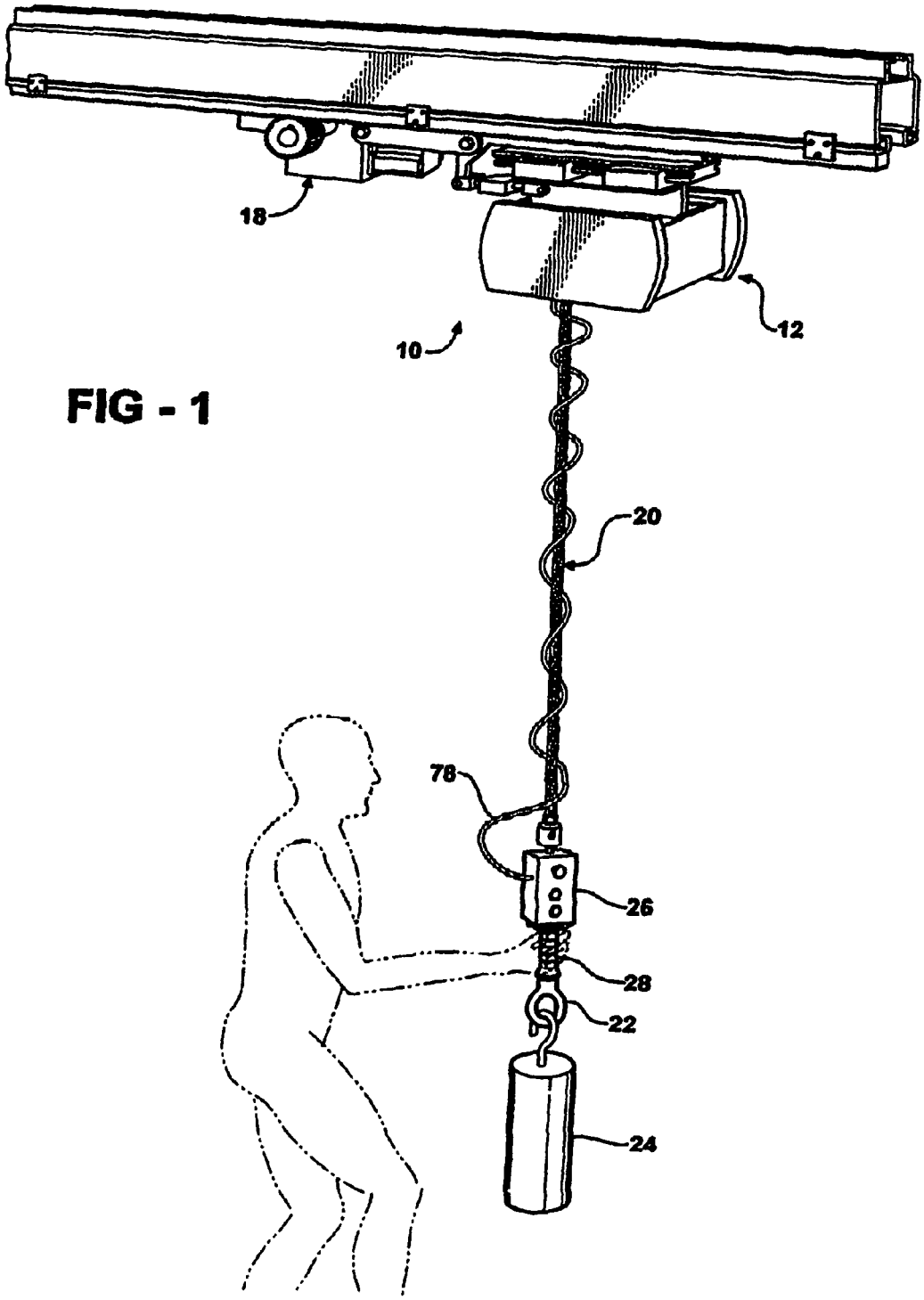
FIG. 1 is a pictorial view of a hoist system and supporting modified overhead according to the present invention.

Referring to the drawings and particularly FIG. 1, a hoist system 10 according to the present invention includes an upper hoist assembly 12 supported on a trolley 14 able to be traversed along an overhead rail 16 by a trolley tractor drive 18 pulling its upper hoist assembly 12 when activated.

A hoist chain 20 is driven up and down by a chain drive arrangement in the upper hoist assembly 12, described below. The hoist chain 20 is connected to a lifting 18 eye 22 on which the load 24 is hung.

A control grip 28 extends below the control box 26.

Two alternately selected basic control modes may be provided. In the first mode, a "float" mode may be provided in which the weight of the load is held stationary and up or down movement of the load 24 is produced by lifting or downwardly pushing on the load 24 itself to cause up or down driving of the chain 20 to raise or lower the load 24 in response to the forces applied to the load 24.

In the second or manual mode, upward pulling or downward pushing on the grip 28 caused up or down driving of the hoist chain 20 and thus of the load 24 at a rate and in a direction corresponding to the magnitude and direction of the forces exerted on the load 24 or grip 28.

The signals generated by components in the control box 26 are transmitted to the hoist controls 29, which may be comprised of a suitably programmed industrial controller as is well known in the art, which in turn controls activation of the hoist motor 25.

Figure 2:
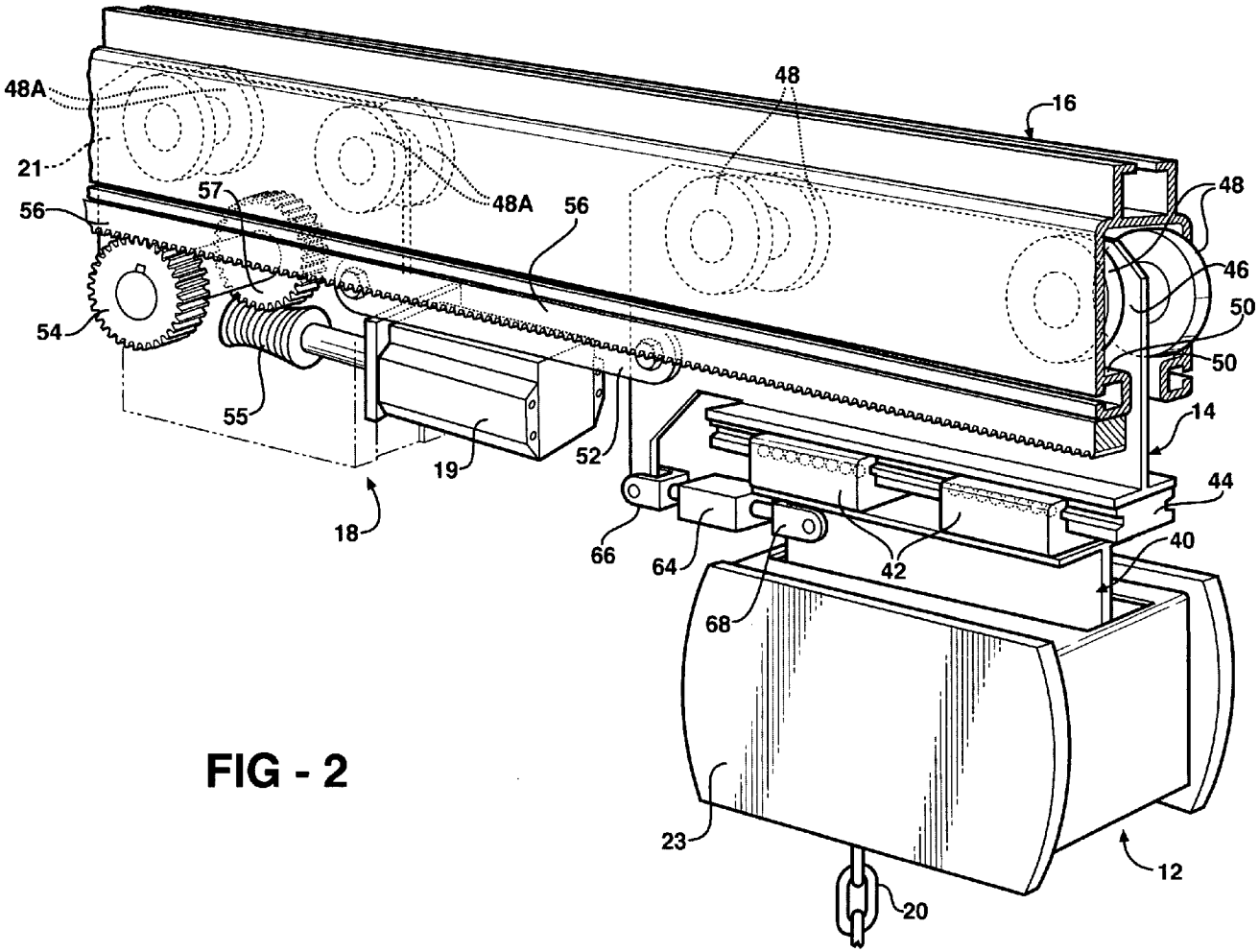
FIG. 2 is an enlarged pictorial view of a hoist upper assembly and trolley tractor drive components included in the hoist system shown in FIG. 1 and a portion of an associated overhead rail.
Figure 3:
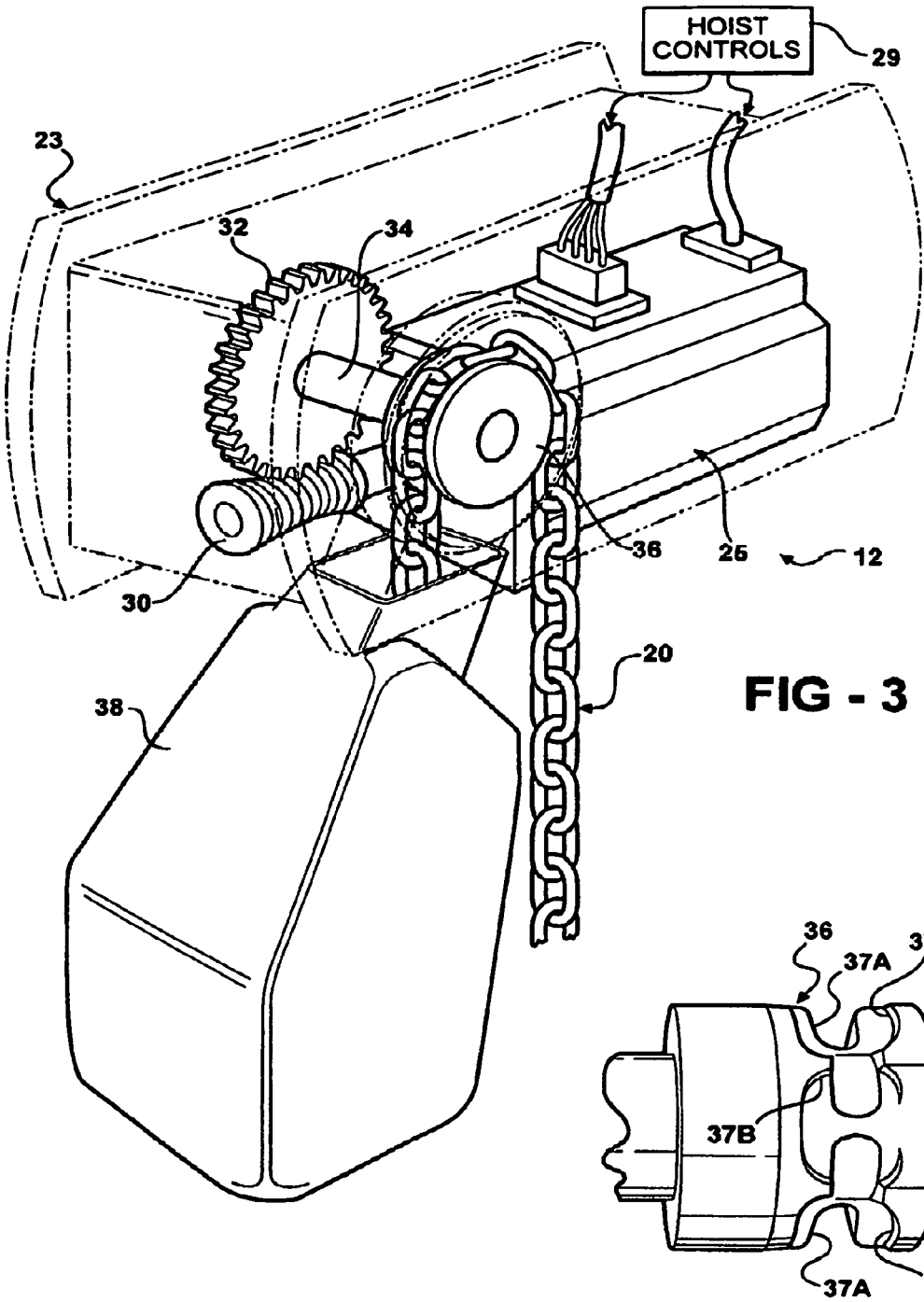
FIG. 3 is a further enlarged pictorial view of certain components of the upper hoist assembly shown in FIG. 2.

FIGS. 2 and 3 show further details of the upper hoist assembly 12.

Figure 3A:
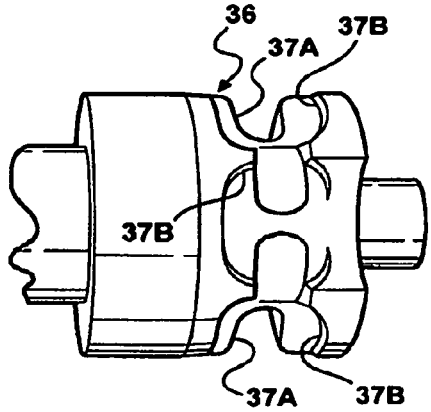
FIG. 3A is an enlarged pictorial view of the chain drive hub shown in FIG. 3.

An electric servo motor 25 is enclosed within housing 23 which drives right angle gearing here comprising a worm gear 30 irreversibly engaged with a worm wheel 32, which is connected to a shaft 34, on which is affixed a chain driving hub 36 of a commercially available type which drives the chain 20 in either direction. FIG. 3A shows the hub 36 has a series of cavities 37A, 37B in which successive chain links are received to create a positive driving connection to the chain 20. The upwardly driven chain 20 can be collected in a receptacle 38, and when downwardly driven, chain is advanced out of the receptacle 38. Since the chain 20 is not wound up on a drum, the collected segment of the hoist chain 20 in the receptacle 38 is not driven by the motor 25 and thus its weight does not affect the performance of hoist.

It is noted that other types of electric motors can be used, other than an electric servo motor, such as a VFD motor.

The upper hoist assembly 12 also includes a trolley support piece 40, having linear bearings 42 affixed thereto engaged with a bearing way 44 of the trolley 14. An upright web 46 supports two pairs of trolley wheels 48.

The trolley wheels 48 roll along rail tracks 50 formed in the conventional overhead rail 16.

The tractor drive carriage 18 is connected to the trolley 14 by links 52. The tractor carriage 18 includes an electric servo motor 19 driving a pinion gear 54 by means of a worm gear 55 and worm wheel 57 engaged with a steel gear rack 56.

Figure 6:
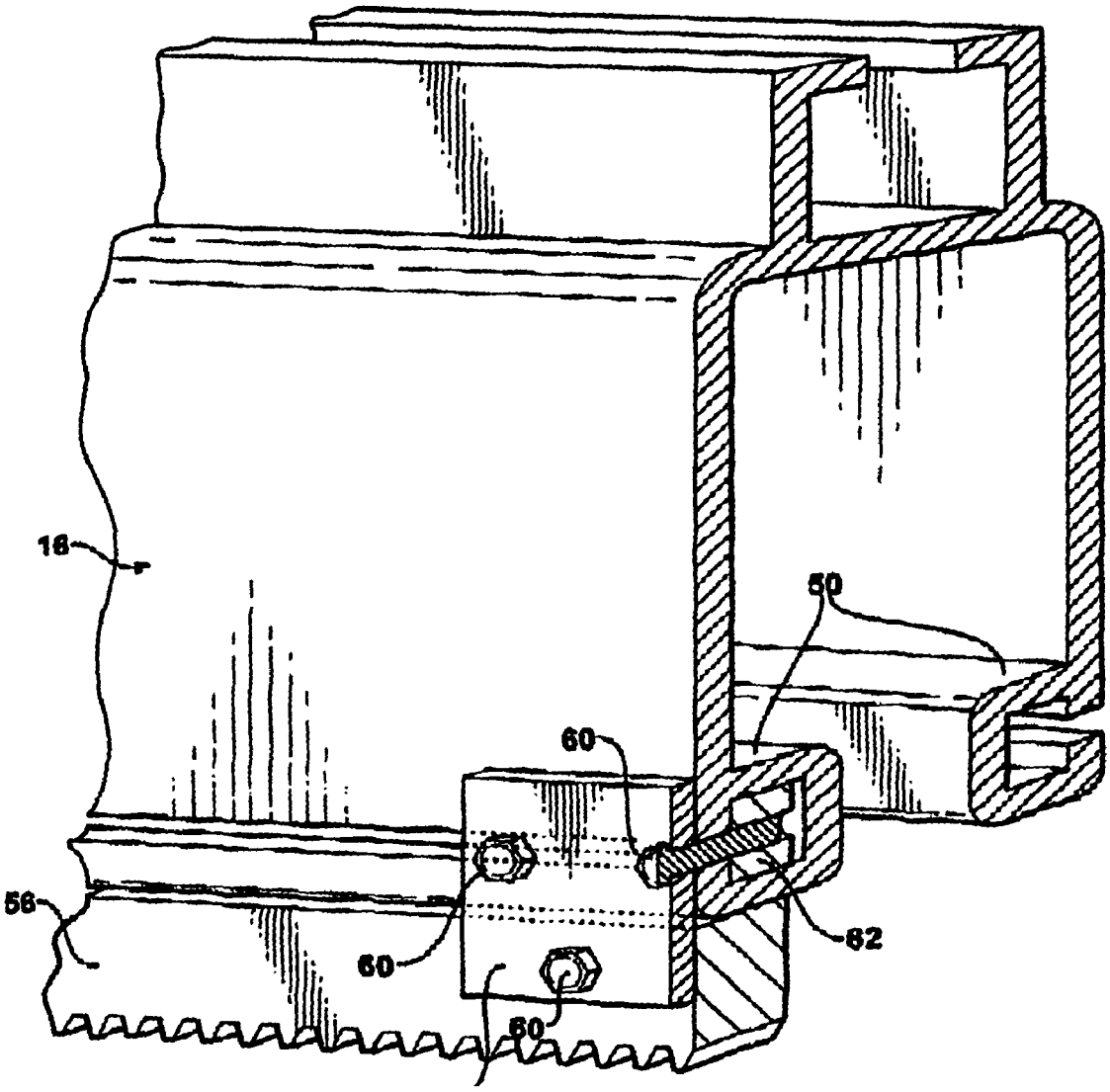
FIG. 6 is an enlarged pictorial view of an overhead track section and attached gear rack for the hoist trolley drive shown in FIGS. 1 and 2.

The tractor carriage 18 includes a central plate 21 mounting tractor carriage wheels 48A rolling on rail tracks 50. The gear rack 56 is held against the underside of one of the tracks 50 of rail 16 by clamping plates 58 affixed to the side of the gear rack 56 by bolts 60 threaded into a hole in the gear rack 56 and into retainer blocks 62 in T slots in the side of the rail 16 (FIG. 6). The reaction to driving by the pinion gear 54 tends to force the gear rack 56 more tightly against the underside of one track 50 of the rail 16 to be quite securely held against the same. Conventional existing aluminum rails can be quickly and easily modified in this way.

A load sensor 64 and an orthogonally arranged pair of yokes 66, 68 interconnects the upper hoist assembly 12 to the trolley 14 which in turn is connected to the tractor carriage 18 via links 52 connected thereto. When an operator pulls on the chain 20 in either direction, the resultant compressive or tensile load exerted on the load sensor 64 is detected, and the tractor carriage 18 is positively driven by motor 19 so as to null the signal generated by load sensor 64 to controllably move the upper hoist assembly 12 in either direction at a rate corresponding to the magnitude of the pull sensed by load sensor 64.

The electric servo motor 19 is activated in a direction and at a rate tending to null the load sensor signals, and thus positively drive the tractor carriage 18 and upper hoist assembly 12 through worm gear 55 and worm wheel 57 along the rail 16 until the operator determines the desired location has been reached and discontinues pulling on the hoist chain 20.

Figure 2A:
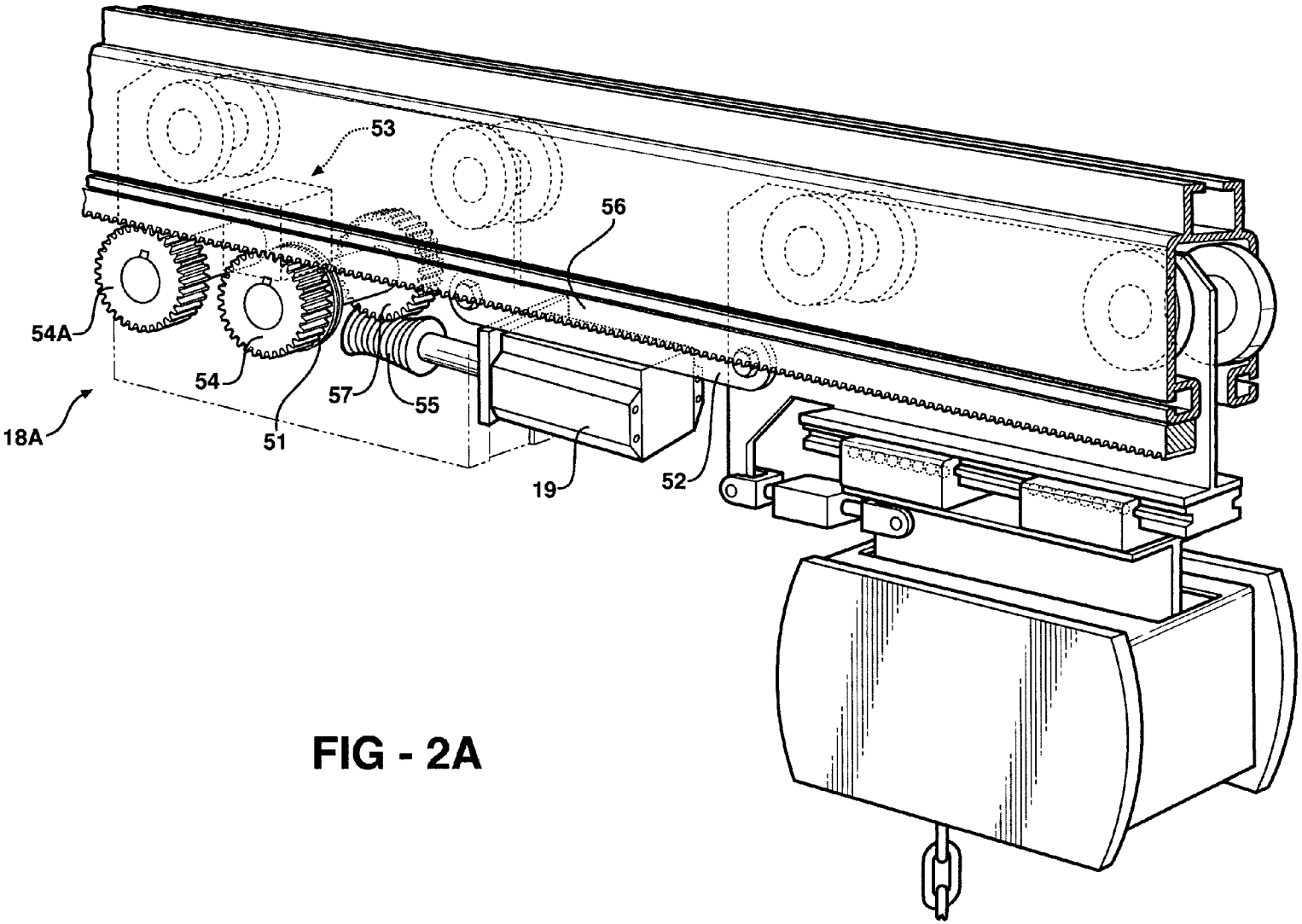
FIG. 2A is a pictorial view of modified form of the trolley tractor drive components.

FIG. 2A shows an alternate form of the tractor drive carriage 18A, in which an electrically operated clutch 51 interposed between the pinion 54 and the drive components 55, 57 is included to allow free rolling of the tractor drive carriage 18A along the rail 16. An encoder 53 driven by a pinion gear 54A engaging the gear rack 56 generates signals corresponding to the linear displacement of the tractor carriage 18A, which allows the position of the tractor carriage 18A to be monitored during free motion of the tractor carriage 18A.

Figure 4:
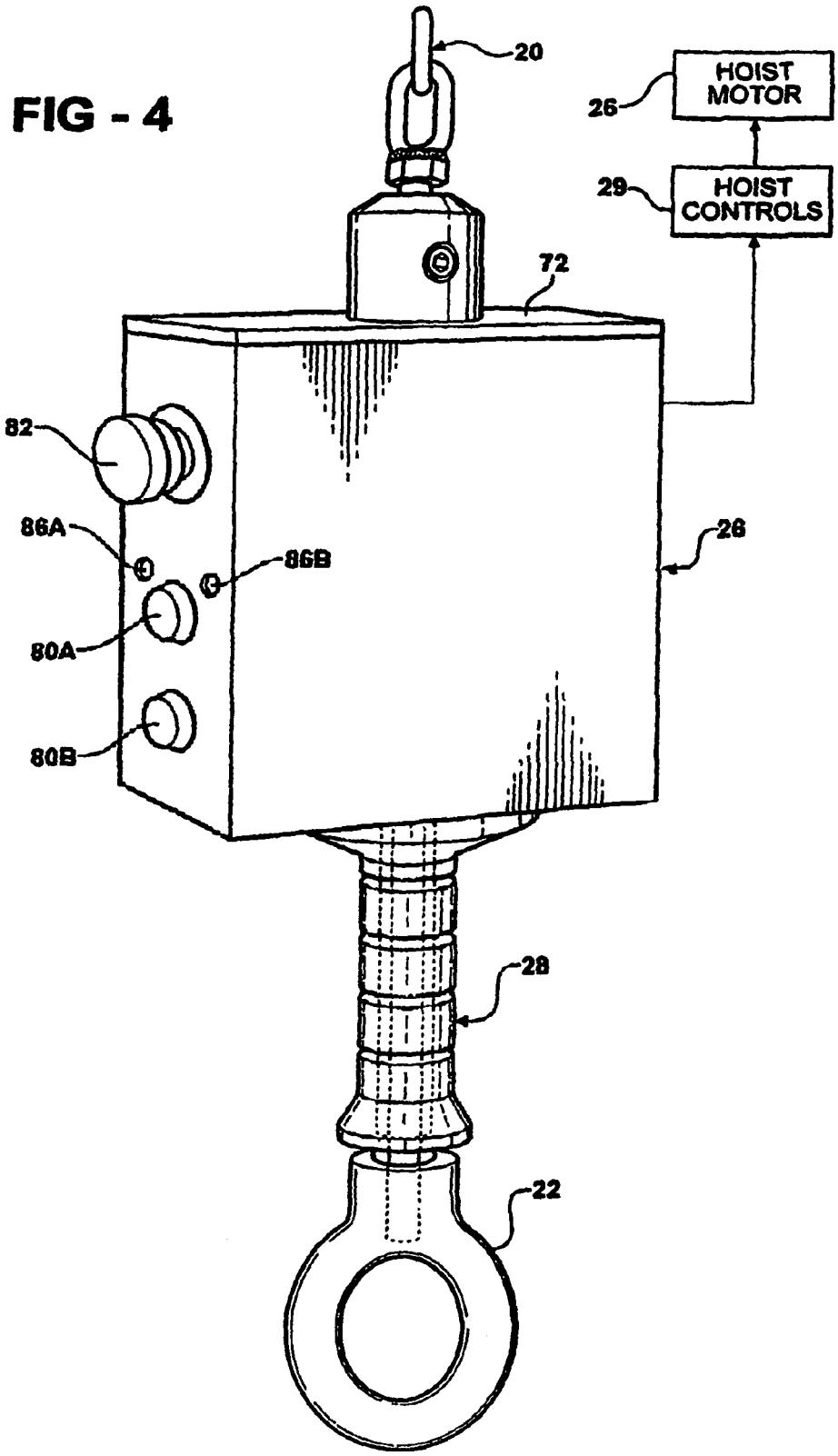
FIG. 4 is an enlarged pictorial view of the control box and manual control grip included in the hoist system shown in FIG. 1.
Figure 5:
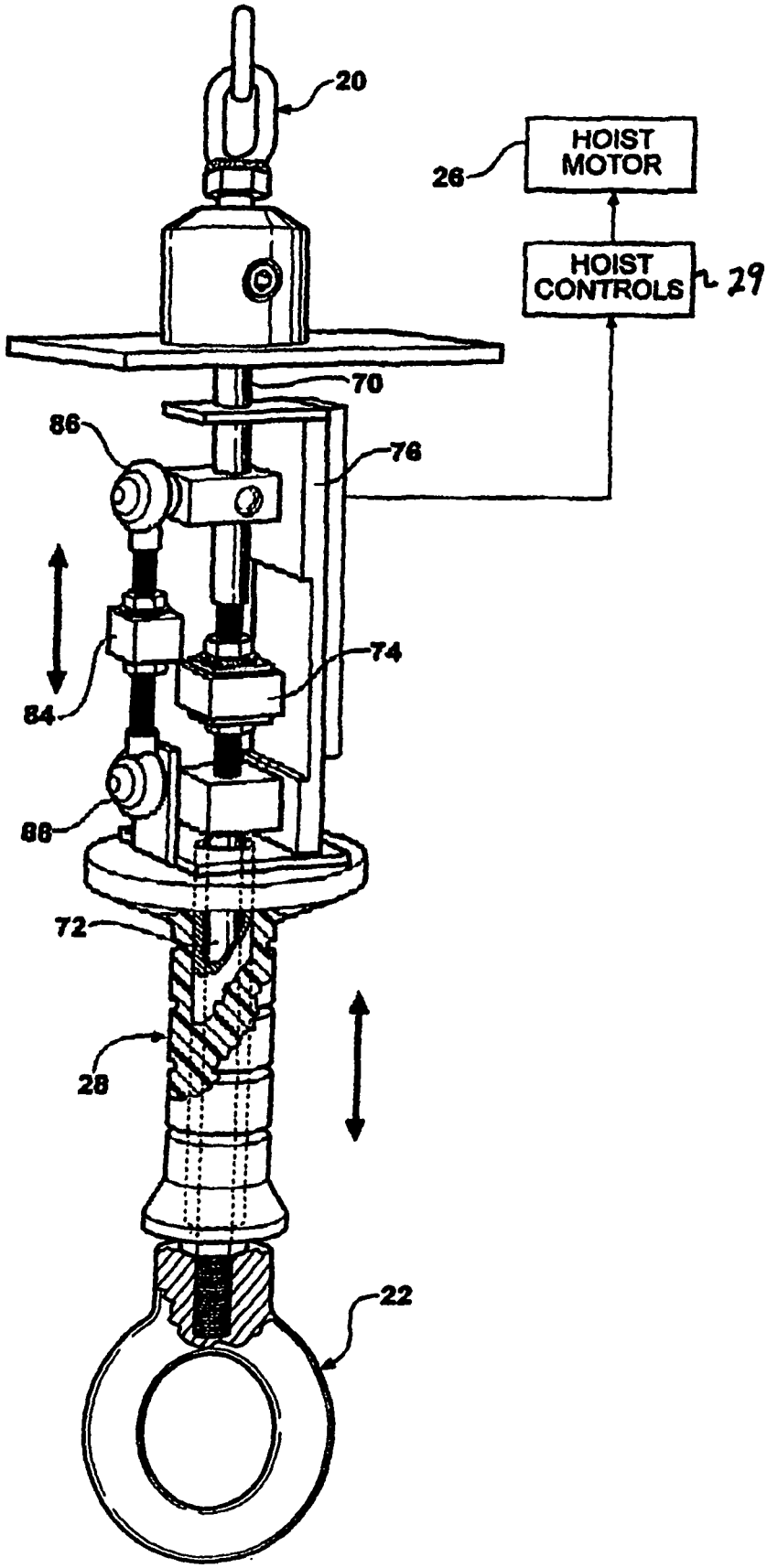
FIG. 5 is an enlarged pictorial view of some of the internal components of the control box and grip shown in FIG. 4.

FIGS. 4 and 5 show further details concerning the control box 26 and control grip 28. The hoist chain 20 is connected to an upper shaft 70 also connected to the top 27 of the control box 26.

The upper shaft 70 is connected to a lower shaft 72 by an intermediate #1 load sensor 74.

The lower shaft 72 is threaded to a lifting eye 22 (or hook) on which the load 24 may be hung. Thus, the load sensor 74 generates electrical signals corresponding to the weight of the load 24. These signals are transmitted via a flexible cable assembly 70 connected by means of a suitable terminal block 23 in the control box 26 mounted to a mounting plate 76 within the control box 26 to a flex cable assembly 78 (FIG. 1) leading to the upper hoist assembly 12. A programmable industrial controller may be used for the hoist controls 29 of a well known type to cause desired preprogrammed responses to inputs from control buttons 80A, 80B and associated switches in the control box (not shown). An emergency stop button 82 is also provided to enable complete stoppage of the servo motor 25.

A #2 load sensor 84 is also provided which is connected on one side to the upper shaft 70 via a self aligning connection 86 and on the other side to the control grip 28 via another self aligning connection 88 and bracket 90 attached to the top of the grip 28. The control grip 28 slidably receives the lower shaft 72 which passes through the same.

The #2 load sensor 84 thus only senses the forces exerted on the control grip 28 and is uninfluenced by the weight of the load, while the #1 load sensor 74 is not influenced by the forces exerted on the grip 28.

Many modes of operation are possible by suitable programming of the hoist controls. The basic modes of operation includes a "float" mode, in which the weight of the load 24 is just balanced by the hoist drive. That is, lifting or pushing down on the load 24 directly, as is done in final positioning of a load, will cause the chain 20 to be driven up or down by activation of the servo motor 25 so as to allow positioning of the load 24 in that manner. This mode may be set by a programmed event, such as by pushing the lower button 80B briefly.

A "manual" mode may be selected as by pushing the upper control button 80A. In this mode, the hoist chain 20 will be driven up if the grip 28 is pulled up, and will be driven down if the grip 28 is pushed down, at rates corresponding to the level to the level of the force exerted on the grip 28. The load 24 is held by the irreversible engagement of the worm gear 30 and worm wheel 32 if no force is exerted on the grip 28.

Upper and lower limits may be optionally preset by suitable programming of the hoist controller 29, i.e. the load 24 driven to an upper limit by controlling activation of the servo motor 25 by pulling the grip 28 upward in the manual mode, and the upper button 82A depressed and held until a light 86A flashes.

A lower limit is set by pushing down on the grip 28 until a desired lower limit is reached, and programmed in by holding lower control button 80B until light 86B flashes.

Other control features could be programmed into the controller 29.

Figure 7:
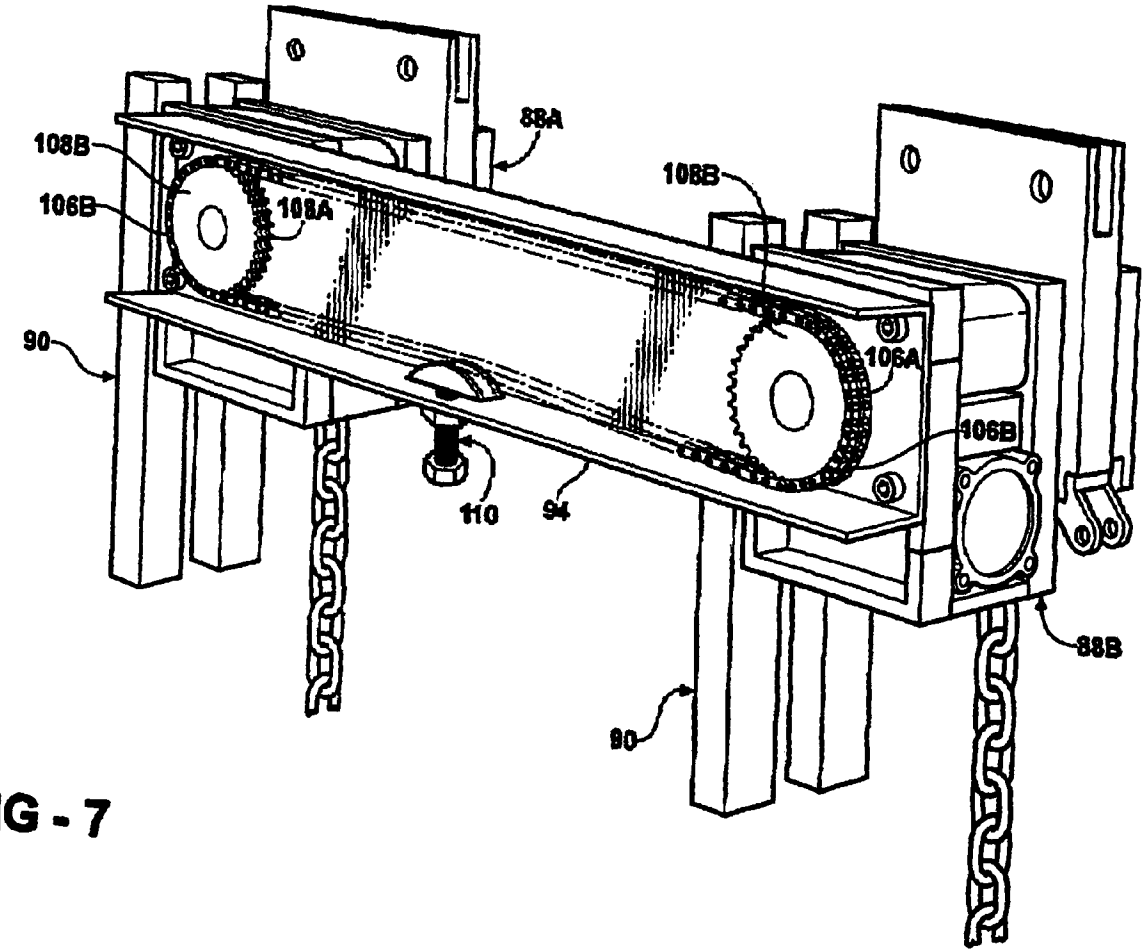
FIG. 7 is a pictorial view of a stationary dual hoist system according to the invention.
Figure 8:
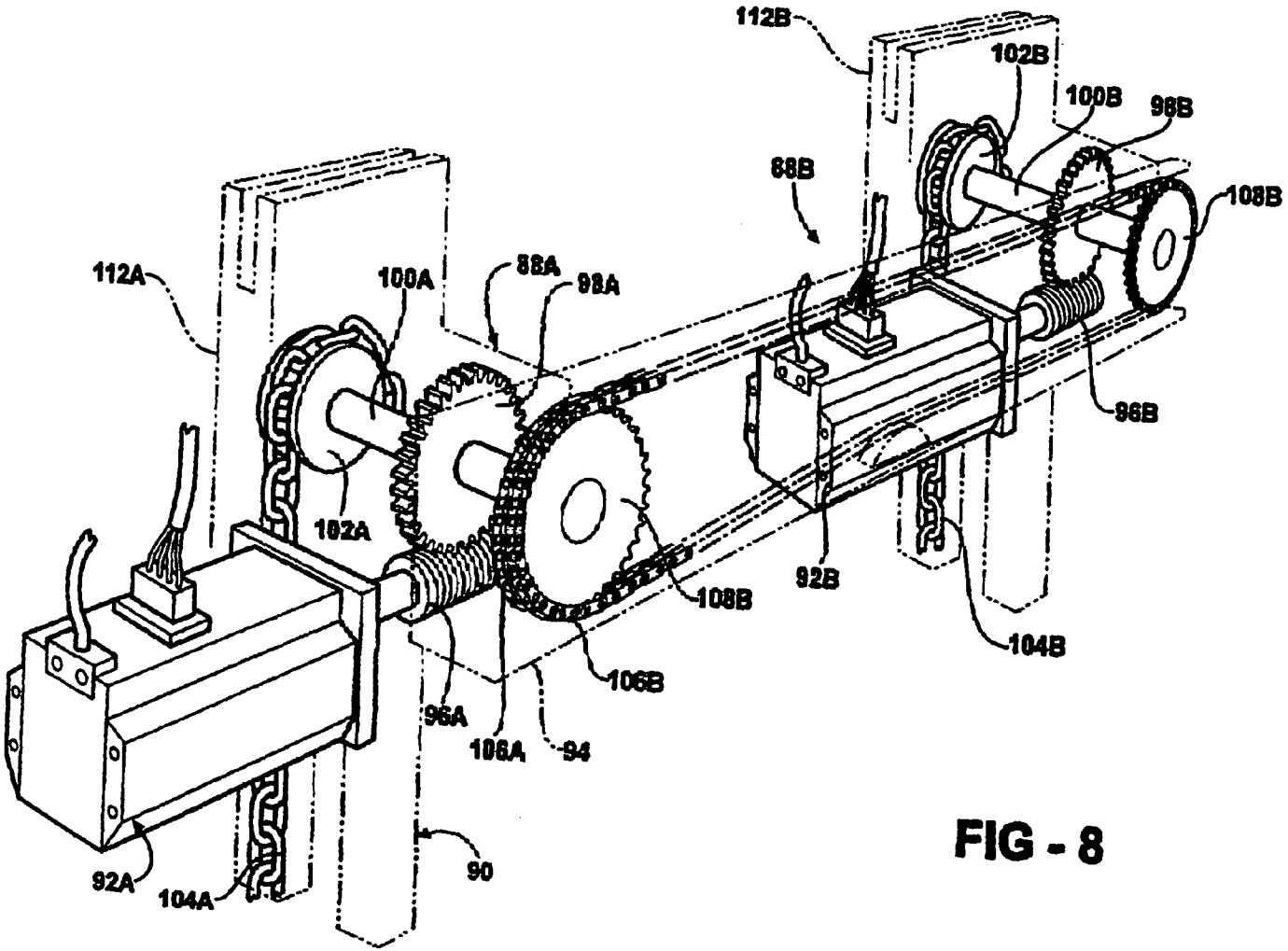
FIG. 8 is a pictorial view of the major internal components of the dual hoist system shown in FIG. 7.

FIGS. 7 and 8 show a stationary double hoist according to the invention.

In this embodiment, two spaced apart hoist assemblies 88A, 88B are mounted on supporting column 90 connected by a cross beam 94.

An electric servo motor 92A, 92B is included in each hoist assembly 88*a*, 88B driving a respective worm gear 96A, 96B in turn irreversibly engaged with a respective worm wheel 98A, 98B mounted on a respective cross shaft 100A, 100B.

Each cross shaft 100A, 100B has a chain drive hub 102A, 102B affixed thereto engaged with a respective one of the two hoist chains 104A, 104B.

A synchronizing double chain 106A, 106B engage both sprocket pairs 108A, 108B affixed to respective cross shafts 100A, 100B. This insures equal movements of the chains 104A, 104B. A chain tensioner 110 can be provided, mounted to cross beam 94.

A pair of hanger plates 112A, 112B can be utilized to support the hoist assemblies 88A, 88B on the cross beam 94.

A single electric motor 92A may be used to drive both chain drive hubs 102A, 102B via the double chain 106A, 106B.

Figure 9:
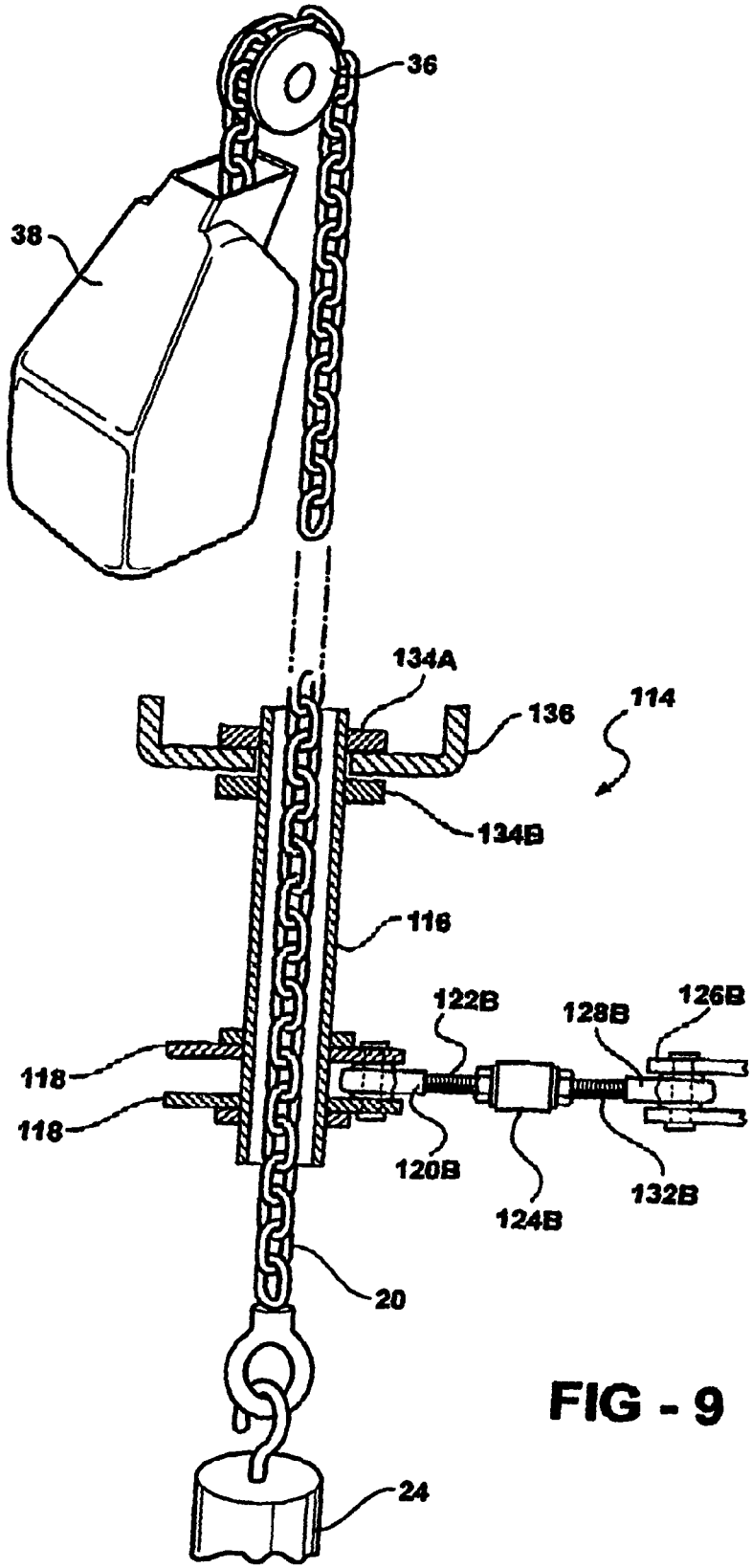
FIG. 9 is a diagram of a two axis sensor arrangement for a traversing hoist system.
Figure 9A:
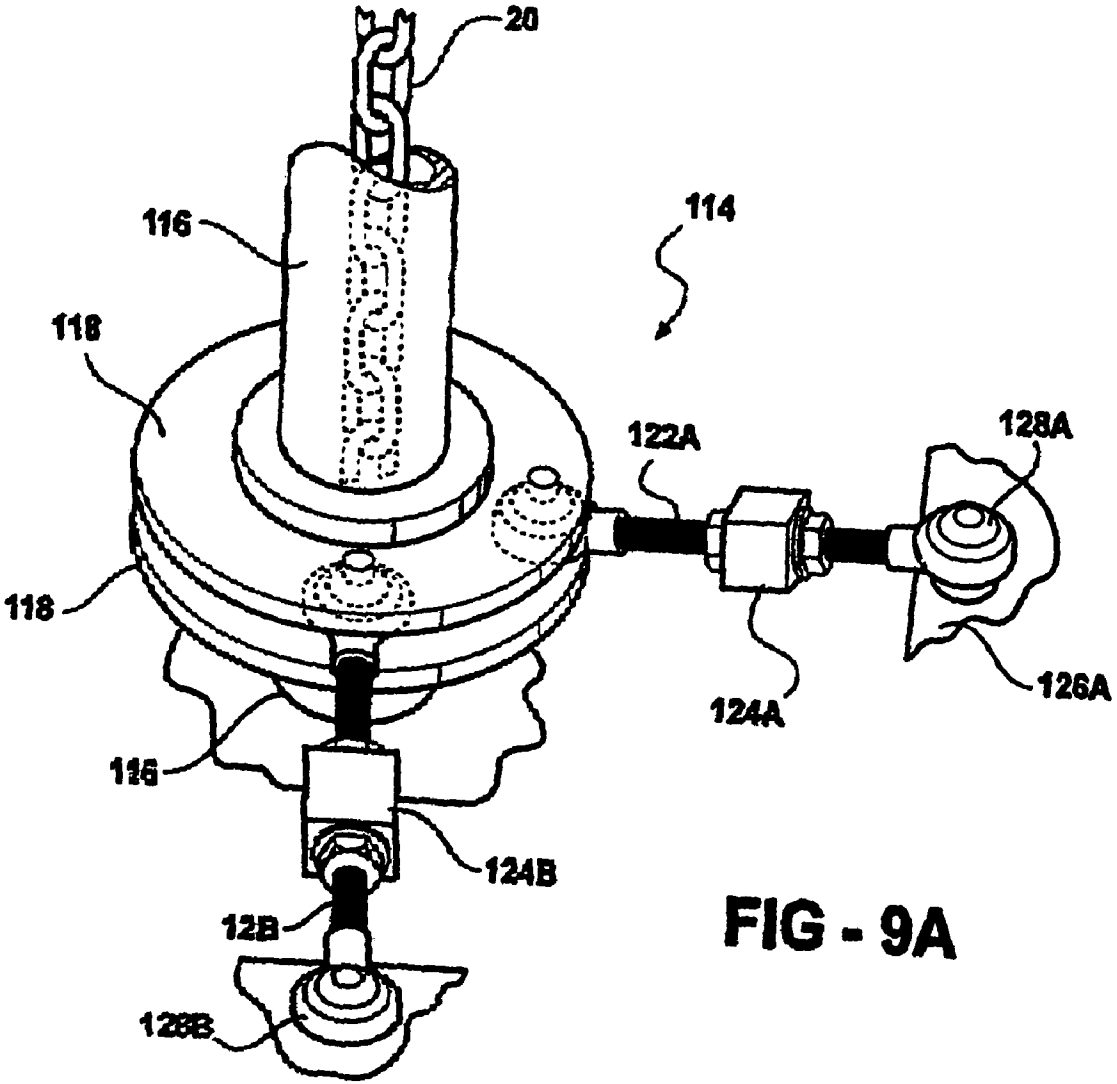
FIG. 9A is rotated pictorial view of the two axis sensor arrangement shown in FIG. 9.
Figure 9B:
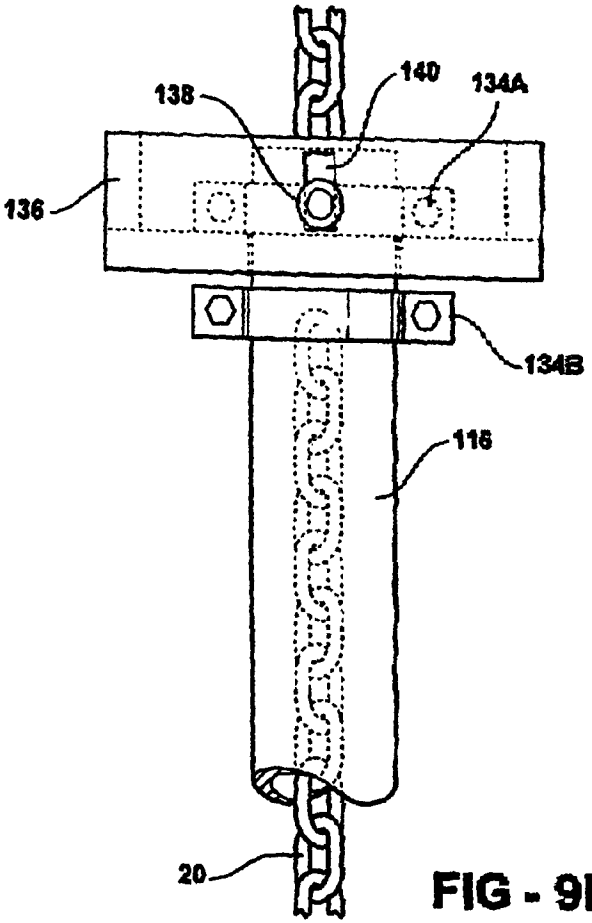
FIG. 9B is a fragmentary portion of the two axis sensor shown in FIGS. 9 and 9A.
Figure 9C:
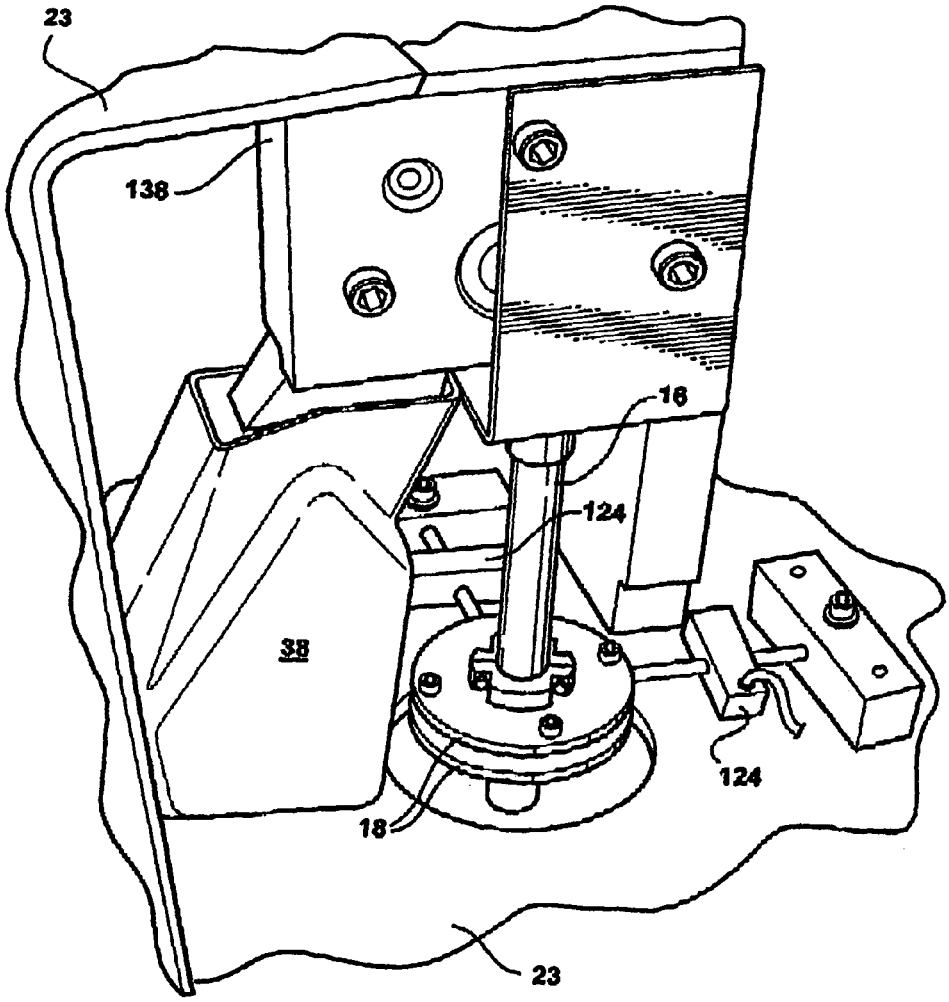
FIG. 9C is a pictorial view of the two axis sensor and associated hoist assembly components.

FIGS. 9-9C show a two axis chain pull sensor 114 mounted in a housing 23.

Figure 10:
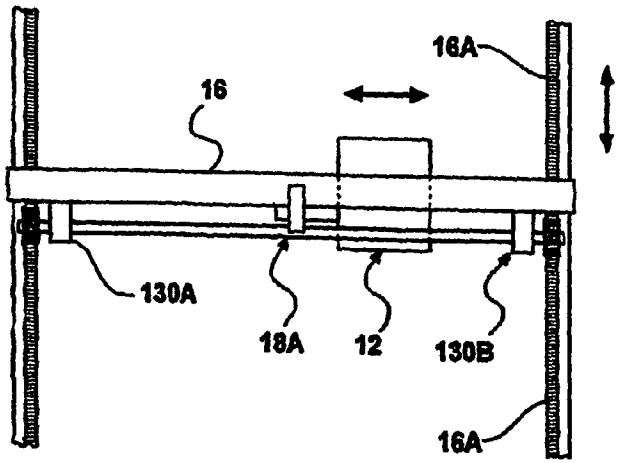
FIG. 10 is a diagrammatic representation of a cross rail arrangement enabling movement of the rail in an orthogonal direction to the rail.

A tube 116 is held and restrained at its upper end by a mounting comprising of two adjustable clamp collars 134A, 134B on either side of a bracket 136. A clearance C is set so that the tube 116 is constrained only by load sensor rods described below when the hoist chain 20 is pulled. One axis is aligned with the rail 16, the other in the direction of bridge rails 16A (FIG. 10) supporting the ends of the rail 16 for movement of the hoist assembly 16 along a direction normal to the rail 16.

An anti-rotation screw 138 is threaded into the upper collar 134A through a slot 140 in the bracket 136.

The tube 116 receives the hoist chain 20 which passes through to the chain drive hub 36 aligned so that the chain 20 does not normally exert any pressure on the tube 116. When the hoist chain 20 is pulled in the direction of either axis, this causes force to be applied in either direction to a respective load sensor 124A, 124B.

The tube 116 has a pair of spaced plates 118 attached which receive self aligning eye connections 120A, B aligned along each orthogonal axis connecting a respective rod 122A, B to load sensor 124A, 124B. A second rod 126A, 126B is held by a fixed mounting block 132A, B receiving another self aligning pivot connection 128A, 128B. The signals generated by load sensors 124A, B are sent to the hoist controls 29 which causes activation of respective tractor drives 18A, 130A, 130B to drive the hoist assembly 12 along rail 16 or rails 16A to position the hoist assembly 12 at points along either axis.

Figure 11:
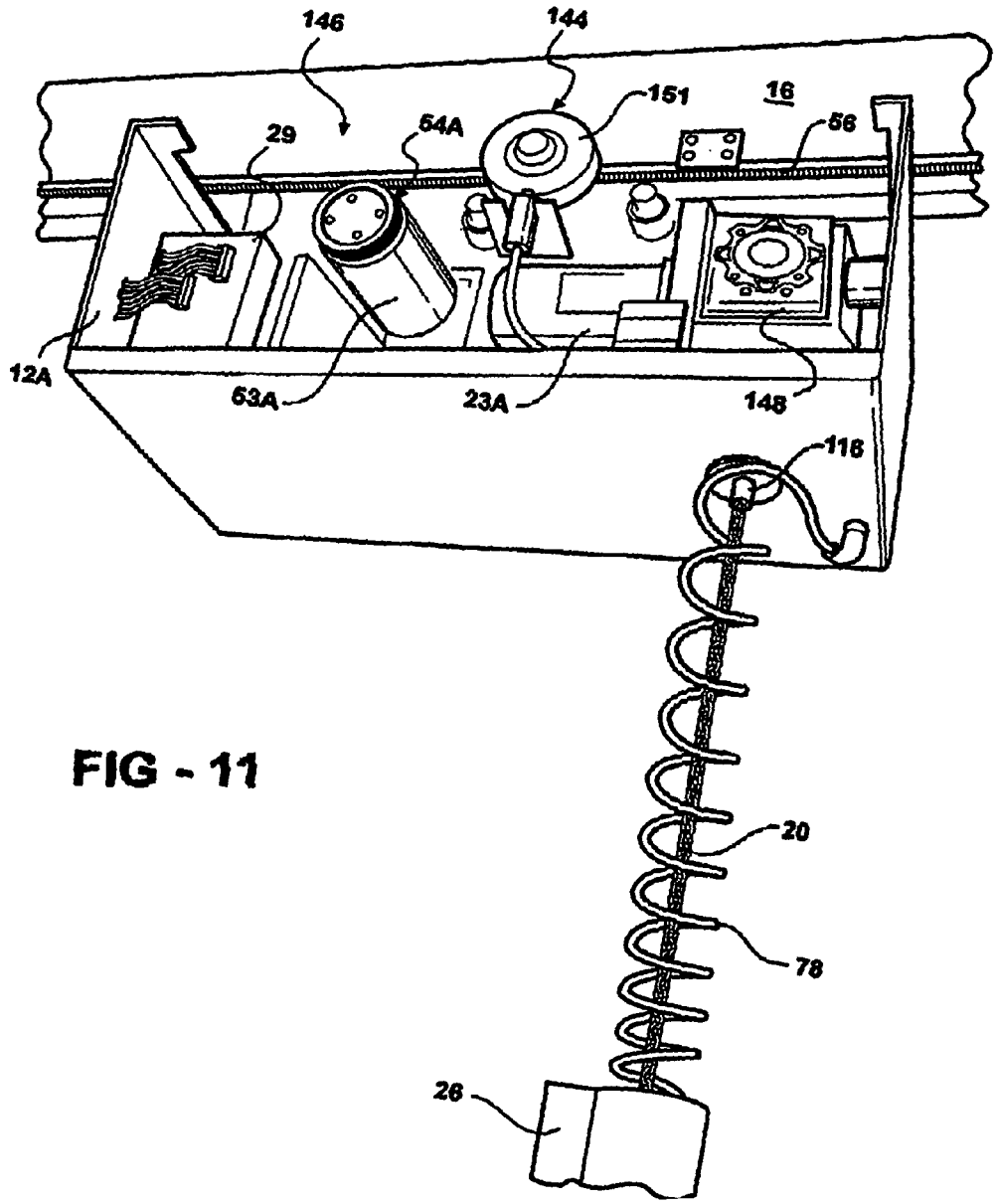
FIG. 11 is a pictorial view of a hoist assembly incorporating the two axis sensor of FIG. 9.

FIG. 11 shows an upper hoist assembly 12A in which the tractor trolley drive and chain drive are both contained in the housing 23A. the tractor drive includes a clutch-pinion gear assembly 144 driven by a servo motor (not shown in FIG. 11) engaged with the gear rack 56. An encoder second pinion gear assembly 146 includes a pinion gear 54A and encoder 53A.

An industrial controller comprising the hoist control 29 is also shown. The chain drive includes an electric servo motor 25 driving irreversible right angle gearing unit 148 incorporating the worm gear and worm wheel (not shown in FIG. 11).

The invention claimed is:

1. A hoist system including an upper hoist assembly supported on an overhead rail for traversing movement along said rail, a hoist chain extending downwardly from said upper hoist assembly which includes a chain drive driving a chain up or down to raise or lower a connected load, said upper hoist assembly supported on a trolley supported for rolling movement along said overhead rail; said upper hoist assembly supported on said trolley so as to be freely movable relative to said trolley in directions parallel to said rail; a tractor carriage also supported for rolling movement along said overhead rail and connected to said trolley for movement therewith; said trolley and upper hoist assembly interconnected with a load sensor which prevents said movement of said upper hoist assembly in directions parallel to said rail and generating signals in response to pulling on said hoist chain with a component force parallel to said rail; a tractor carriage drive normally holding said tractor carriage and connected trolley and activated in response to said load sensor signals correspondingly moving said trolley and said connected upper hoist assembly together along said overhead rail in a direction tending to null said signals.

2. The hoist system according to claim 1 wherein said tractor carriage drive includes an electric servo motor and gearing driven thereby, said gearing including a pinion gear engaging an elongated gear rack mounted to extend along said overhead rail and irreversible gearing driven by said servo motor driving said pinion gear.

3. The hoist system according to claim 2 further including a clutch allowing disconnection of said pinion gear, selectively allowing free movement of said tractor carriage and trolley and an encoder driven by a second pinion gear engaged with said gear rack allowing determination of the extent of the motion of said tractor carriage and trolley during free rolling movement thereof.

4. The hoist system according to claim 1 wherein said tractor carriage and said trolley are interconnected with one or more links.

5. The hoist system according to claim 1 wherein said hoist assembly is supported on said trolley with bearings to be movably mounted thereon.

6. The hoist system according to claim 1 further including cross rails supporting said rail for movement along an orthogonal direction and a second tractor carriage and a second tractor carriage drive for driving said rail along said cross rails, and a sensor device for sensing pulling in said orthogonal direction and generating signals controlling said second tractor carriage drive.

* * * * *